US008814118B2

(12) United States Patent
Okita et al.

(10) Patent No.: US 8,814,118 B2
(45) Date of Patent: Aug. 26, 2014

(54) HOLDING DEVICE OF CYLINDRICAL BODY AND MICROPHONE HOLDER

(75) Inventors: Shioto Okita, Machida (JP); Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 0 days.

(21) Appl. No.: 13/559,042

(22) Filed: Jul. 26, 2012

(65) Prior Publication Data

US 2013/0061430 A1 Mar. 14, 2013

(30) Foreign Application Priority Data

Sep. 8, 2011 (JP) ..... 2011-195602

(51) Int. Cl.
*H04R 9/08* (2006.01)
*H01F 7/02* (2006.01)
*H04R 1/08* (2006.01)

(52) U.S. Cl.
CPC ..... *H01F 7/0252* (2013.01); *H04R 1/08* (2013.01)
USPC ..... 248/316.3; 381/363; 381/368; 381/366; 248/313.5; 248/231.51; 248/689; 24/495

(58) Field of Classification Search
USPC ..... 248/688–689, 67.7, 74.2, 74.1, 206.5, 248/229.11, 229.1, 230.1, 316.5, 176.1, 248/604; 224/929, 247; 24/303, 327, 305; 381/368, 366, 362, 363; 84/435
See application file for complete search history.

(56) References Cited

U.S. PATENT DOCUMENTS

| | | | | |
|---|---|---|---|---|
| 2,719,050 | A * | 9/1955 | Teetor | 292/251.5 |
| 4,194,096 | A * | 3/1980 | Ramsey | 381/366 |
| 6,591,462 | B2 * | 7/2003 | Fuhrman | 24/303 |
| 7,308,737 | B2 * | 12/2007 | Saitoh et al. | 24/303 |

* cited by examiner

*Primary Examiner* — Jack W Lavinder
(74) *Attorney, Agent, or Firm* — Manabu Kanesaka

(57) ABSTRACT

A microphone holder is provided that allows a microphone to be attached and detached by a one-touch operation and to be securely held. A first and a second magnet 77*a* and 72*b* are provided at positions where a holding frame 5 and a clamp arm 6 overlap with each other such that different poles are opposed to each other. The magnets are magnetically attached to each other to lock the movement.

10 Claims, 3 Drawing Sheets

HOLDING DEVICE OF CYLINDRICAL BODY AND MICROPHONE HOLDER

CROSS-REFERENCE TO RELATED APPLICATION

The present application is based on, and claims priority from, Japanese Application Serial Number JP2011-195602, filed Sep. 8, 2011, the disclosure of which is hereby incorporated by reference herein in its entirety.

TECHNICAL FIELD

The present invention relates to a holding device of a cylindrical body that holds the body having a cylindrical shape to be held, and more specifically to a microphone holder that can hold a microphone grip, as the body to be held, easily and securely by a light operation.

BACKGROUND ART

An example of a holder that regards a cylindrical body as a body to be held is a microphone holder. In the case of holding a microphone at a prescribed position, a microphone stand is typically used. The stand includes a stand body placed on an installation surface, such as a floor. A microphone holder for holding the microphone is attached to the distal end of the stand body.

There are various types of microphone holders for respective uses. For instance, the most popular type is described in Japanese Utility Model No. 3093594. As described therein, a holder includes an elastically deformable clamp member formed to have a C-shaped section. The grip of a microphone is pressed into an opening of the holder, and elastically clamped.

However, such microphone holders are a forcedly fitting type according to which the opening of the clamp member is pressed open and the grip is mounted. Since a strong pressing force is required, this type is inferior in operability. Furthermore, when the grip is pressed against the opening to be forcedly fit, the microphone holder and the grip sometimes collide strongly with each other and the microphone picks up collision noise caused by the collision.

Thus, microphone holders used for a hand-held microphone that frequently repeats attachment and detachment of the microphone include a shock absorbing material that is made of an adhesive engineering plastic and adheres to the inner surface of the holder. However, this configuration is unfavorable in cost and causes a problem in that long-term deterioration of peeling off.

Another holding device holding any of cylindrical bodies equivalent to the microphone grips, for instance, a flashlight and various types of grips, adopts the forcedly fitting type and requires a strong pressing force. This causes a problem in inferior operability.

It is thus an object of the present invention to provide a holding device of a cylindrical body that can hold various types of cylindrical bodies, including a cylindrical microphone grip, more easily and securely, by a light operation.

SUMMARY OF THE INVENTION

In order to achieve the object, the present invention includes any of following characteristics. A holding device of a cylindrical body adopts the cylindrical body as a body to be held, and includes: a holding frame having a C-shaped section for holding an outer circumferential surface of the cylindrical body; and a clamp arm attached swingably at a front end of the holding frame, wherein the holding frame and the clamp arm are provided with first lock means for holding the holding frame and the clamp arm at a position where the clamp arm and the holding frame overlap with each other, the first lock means includes a first magnet accommodated in a first recess provided on one of surfaces opposite to each other in a state where the holding frame and the clamp arm overlap with each other, and a second magnet accommodated in a second recess provided on the other surface, the magnets being disposed such that different pole surfaces are opposed to each other, at least the first magnet has an outer diameter smaller than an inner diameter of the first recess, a magnetic member to magnetically attract the first magnet is disposed at a bottom of the first recess, and the first magnet moves to a side of the second magnet and is magnetically attached to the second magnet at the position where the holding frame and the clamp arm overlap with each other.

Accordingly, the first magnet moves toward the second magnet at the position where the clamp arm and the holding frame overlap with each other, and the magnets are magnetically attached to each other, which magnetically locks the holding frame and the clamp arm to each other.

In a more preferable mode, at least the first recess is formed to have a depth longer than a length of the first magnet in an axial direction.

The first recess is thus formed to have a depth longer than the length of the first magnet in the axial direction. Accordingly, the movement stroke of the magnet becomes long, thereby allowing a collision sound to be louder.

The present invention further includes second lock means for mechanically regulating swing of the clamp arm at the position where the holding frame and the clamp arm overlap with each other.

The second lock means for mechanically regulating swing of the clamp arm is thus provided, thereby allowing the clamp arm to be securely immobilized.

In a more preferable mode, the second lock means includes an insertion hole provided at one of the holding frame and the clamp arm, and an insertion pin provided at the other of the holding frame and the clamp arm, and relative movement between the holding frame and the clamp arm is mechanically locked by inserting the insertion pin into the insertion hole.

Thus, the second lock means includes the insertion hole provided on one of the holding frame and the clamp arm, and the insertion pin provided at the other of the holding frame and the clamp ann. Accordingly, insertion of the insertion pin into the insertion hole allows the relative movement between the holding frame and the clamp arm to be mechanically locked.

The present invention also includes a microphone holder for holding a microphone grip as the cylindrical body.

DETAILED DESCRIPTION

An embodiment of the present invention will now be described with reference to drawings. However, the present invention is not limited thereto.

Figure 1A:
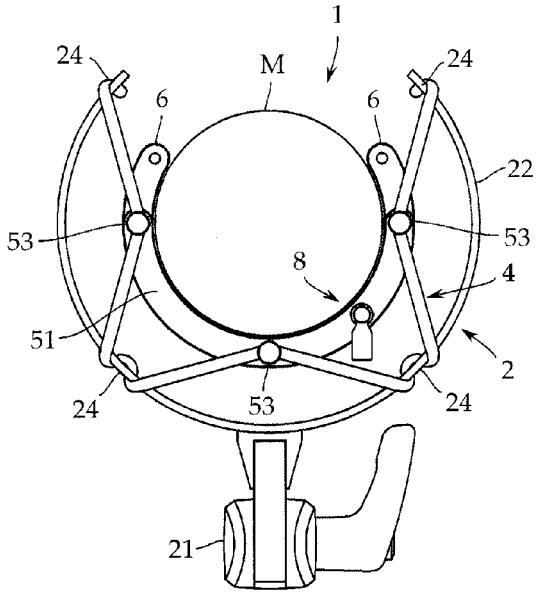
FIG. 1A is a front view of a microphone holder according to one embodiment of the present invention.

As shown in FIG. 1, a holding device 1 of a cylindrical body will now be described with a microphone holder 1 that supports a microphone M in an example. A microphone holder 1 is for holding a microphone M including a cylindrical grip G, and preferably used in a state of being suspended by a vibration isolating rubber cord 4 from a microphone mounter 2 attached to a microphone stand, not shown. The microphone grip G does not necessarily have a simple cylindrical shape. Instead, this grip may be Ruined into a circular conical shape.

The microphone mounter 2 includes a base 21 to be attached to, for instance, the front end of the microphone stand and a hanger 22 swingably attached to the base 21, which are connected to each other swingably about a turning shaft 23.

The base 21 may be a molded article made of a rigid resin. A female thread is provided at the bottom (the right hand side in FIG. 1B) of this base. The female thread and a male thread, which is to be screwed into the female thread, are not shown.

Figure 1B:
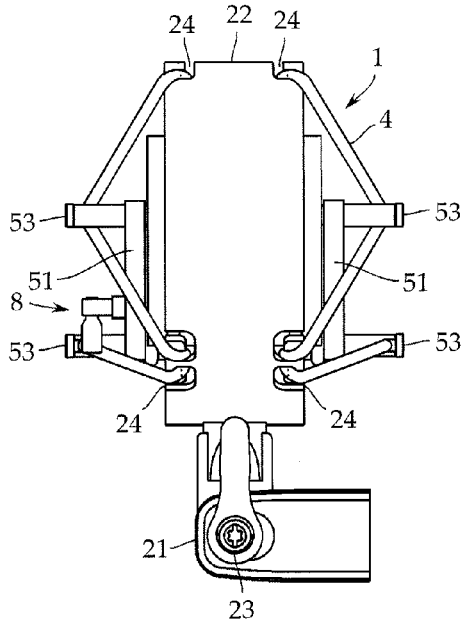
FIG. 1B is a side view of the microphone holder according to the embodiment of the present invention.

The hanger 22 may likewise be a molded article made of rigid resin, and includes a casing that has a C-shaped section and arranged along the outer circumference of the microphone holder 1 with a prescribed separation therefrom. As shown in FIG. 1B, hooks 24 by which the rubber cord 4 is hooked are provided on opposite sides of the hanger 22. In this example, the hooks 24 are provided at four sites on each side. The microphone holder 1 is held suspended within the hanger 22 by the rubber cord 4.

Instead, the hanger 22 may be made of steel and have a structure where a vibration control material adheres to the surface thereof, or have a structure made of a combination of a steel plate and a plastic. The specific form and specifications are arbitrary.

The microphone mounter 2 has any specific shape only if the mounter can hold the microphone holder 1 in a suspended manner. Any material and shape may be selected as those of the rubber cord 4 in conformity with specifications only if the cord is an elastic cord-shaped body that has an appropriate elasticity capable of suspending the microphone holder 1 and has vibration controllability for suppressing input of noise.

Figure 2:
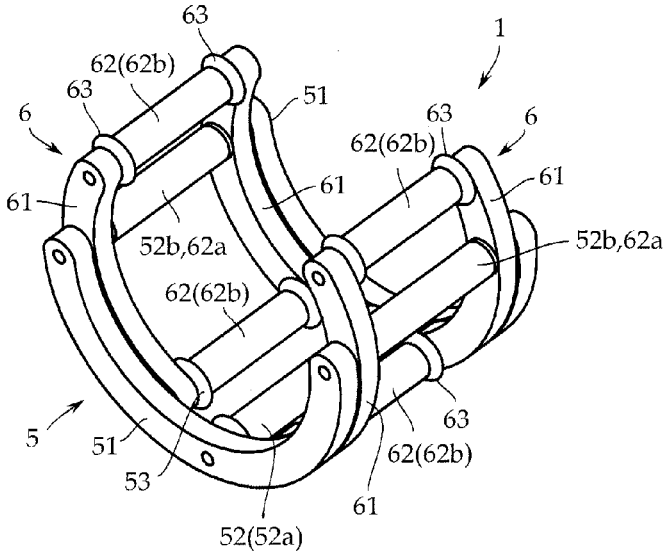
FIG. 2 is a perspective view of the microphone mounter of the microphone holder.
Figure 3A:
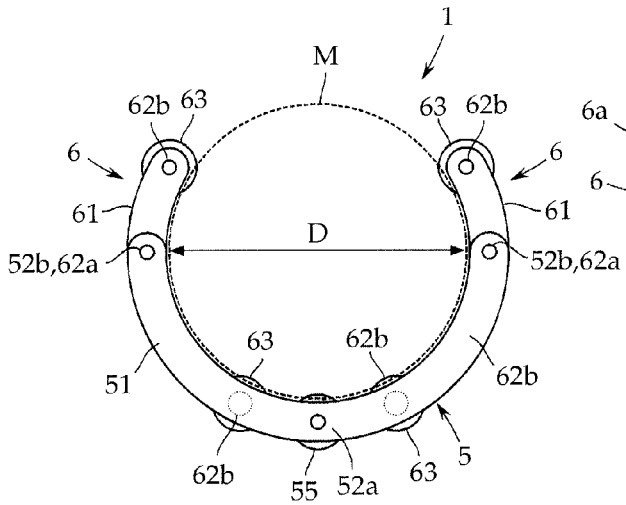
FIG. 3A is a front view of the microphone holder in a state where a clamp arm is closed.
Figure 3B:
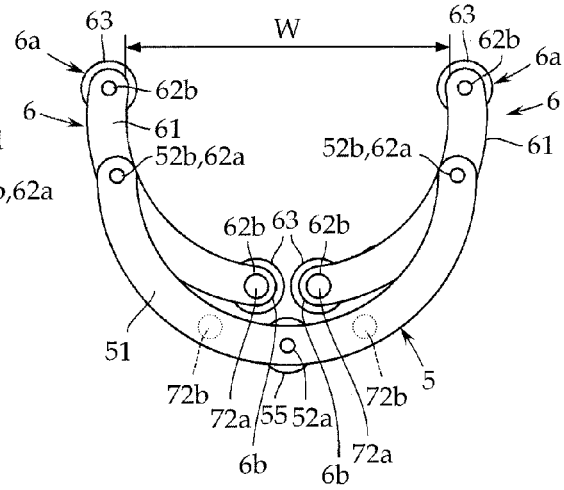
FIG. 3B is a front view of the microphone holder in a state where the clamp arm is opened.
Figure 4:
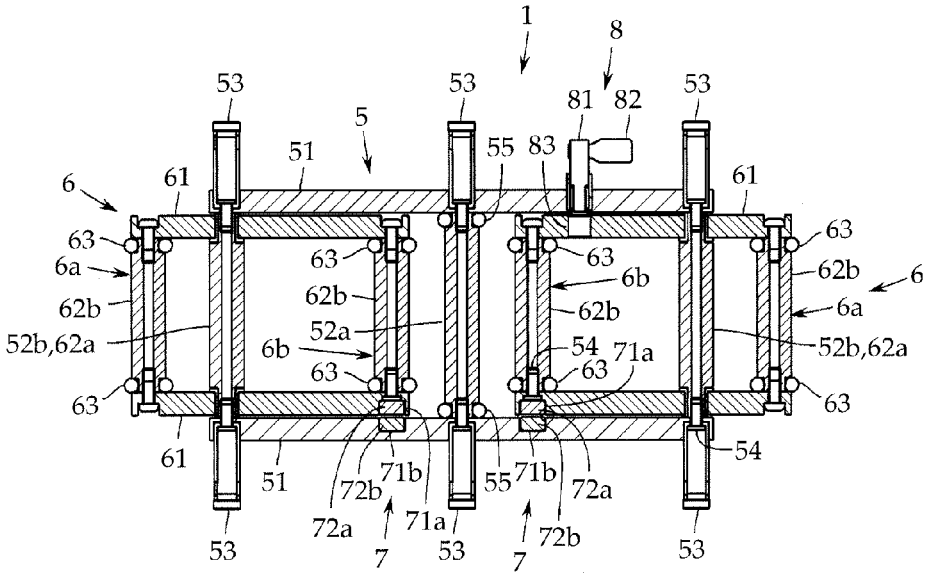
FIG. 4 is a sectional view of the microphone holder in a state of being expanded into a plane.

Next, also referring to FIGS. 2 to 4, the microphone holder 1 according to this embodiment includes: a holding frame 5 that has a C-shaped section formed to be arranged along the outer circumferential surface of the microphone grip G included in the microphone; and a pair of clamp arms 6 and 6 swingably attached to the respective opposite ends of the holding frame 5.

The holding frame 5 includes frame bodies 51 and 51 disposed to be opposite to and separated from each other by a prescribed interval along the axial direction of the microphone grip G, and has what is called a ladder-frame structure, in which, for instance, three connecting shafts 52 connect the frame bodies 51 and 51 to each other.

The frame bodies 51 and 51 configuring the holding frame 5 are formed into a circular arc shape whose length of the circumference is equal to or less than half of the length of the circumference of the microphone grip G. In this example, this length is half the length of the circumference.

In this example, the three connecting shafts 52 are fixedly screwed to opposite ends (52*b* and 52*b*) and the center (52*a*) of each frame body 51. However, any number and fixing positions of connecting shafts 52 may be selected and adopted in conformity with specifications.

As shown in FIG. 4, three hook rods 53, by which the rubber cord 4 is hooked to the microphone holder 1, are provided at respective positions on the outer surface of each of frame bodies 51 and 51. Each hook rod 53 is integrally fixed onto the outer surface of the frame body 51 together with a screw 54 for fixing the connecting shaft 52 to the frame body 51.

A vibration isolating ring 55 as a vibration isolator which contacts the microphone grip G is attached to the center connecting shaft 52*a* among the connecting shafts 52. The vibration isolating ring 55 is, for instance, a ring body made of an elastic rubber material. In this example, this ring is provided at each of the opposite ends of the connecting shaft 52*a*. Instead, this ring may be provided at the center of the connecting shaft 52*a*.

In this example, the vibration isolating ring 55 is provided at each of the opposite ends of the connecting shaft 52*a*. However, a vibration isolating ring 55 formed into a macaroni shape may be inserted over the connecting shaft 52*a* so as to cover the entire shaft. Instead, the ring is formed integrally on the surface of the connecting shaft 52*a*.

Next, each clamp arm 6 includes: a pair of arm bodies 61 and 61 arranged separated in the axial direction of the microphone grip G; and a plurality of connecting shafts 62 connecting the arm bodies 61 and 61 to each other.

The arm bodies 61 and 61 are formed into a circular arc shape as with the frame body 51 described above. In this example, the arm bodies are formed to have the length of the circumference shorter than the length of the circumference of the holding frame 5.

The connecting shafts 62 are arranged at the opposite ends (62*b* and 62*b*) and the midway (62*a*) of the arm bodies 61 and 61. In this example, the connecting shafts 52*b* connecting the respective opposite ends of the frame bodies 51 also serve as the intermediate connecting shafts 62*a*. The clamp arms 6 are connected to the respective opposite ends of the holding frame 5 swingably about the connecting shaft 52*b* (62*a*) as the swing shaft.

In this example, the swing shaft 62*a* is provided to be displaced by one third of the arm length from the front end 6*a* of the clamp arm 6. However, the swing position may be provided any intermediate position between the front end 6*a* and the rear end 6*b* of the clamp arm 6.

A vibration isolating ring 63 as a vibration isolator in contact with the microphone grip G is attached to each of the connecting shafts 62*b* and 62*b* at the opposite ends of the clamp arm 6. In this example, the vibration isolating ring 63 is substantially the same as the vibration isolating ring 55 of the holding frame 5, and arranged at each of the opposite ends of each of the connecting shafts 62*b* and 62*b*, the ends being separated in the axial direction.

In the present invention, as shown in FIG. 3A, the holding frame 5 and the clamp arms 6 are formed into the circular arcs having the same curvature, and intermediate parts of the clamp arms 6 are attached to the respective opposite ends of the holding frame 5 swingably about the connecting shafts 52*b* (62*a*). Accordingly, the sum of the length of the circumference from the front end 6*a* to the swing shaft 62*a* of each of the clamp arms 6 and 6 and the length of the circumference of the holding frame 5 is at least half the length of the circumference of the microphone grip G.

Thus, in the state where the clamp arms 6 and 6 are closed, the holding frame 5 and the clamp arm 6 hold the microphone grip G around at least half the circumferential length of the outer circumferential surface of the grip. This prevents the grip from dropping off.

As shown in FIG. 3B, outwardly opening of the front ends 6*a* of the respective clamp arms 6 and 6 allows the opening width W of the microphone holder 1 to be larger than the diameter D of the microphone grip G. Accordingly, the microphone grip G can be smoothly inserted into and removed from the microphone holder 1 in a direction orthogonal to the axis.

As shown in FIG. 4, first lock means 7 for notifying the position when the clamp arms 6 and 6 are closed is provided at each of the overlapping parts between the holding frame 5 and the clamp arms 6 and 6.

Figure 5A:
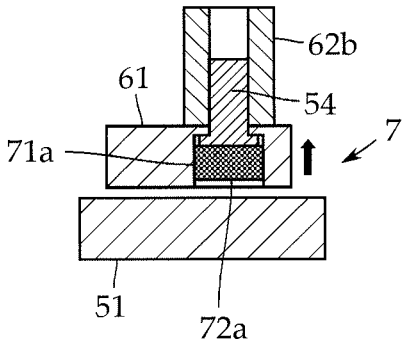
FIG. 5A is a schematic diagram of magnets in a state where clamp arms are opened.
Figure 5B:
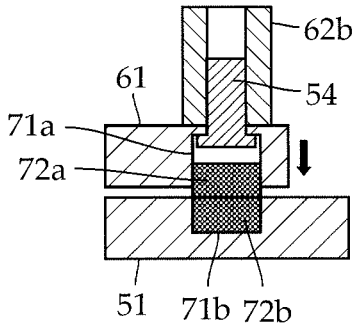
FIG. 5B is a schematic diagram of the magnets in a state where the clamp arms are closed.

As shown in FIG. 5B, the first lock means 7 includes: a pair of recesses 71*a* and 71*b* disposed such that the holding frame 5 and the clamp arms 6 and 6 are opposed in a state of matching with each other; and a pair of magnets 72*a* and 72*b* disposed in the respective recesses 71*a* and 71*b*. These magnets are arranged such that different poles are opposed to each other.

One magnet 72*a* (hereinafter referred to as the first magnet 72*a*) is formed to have an outer diameter smaller than the inner diameter of the recess 71*b* (hereinafter referred to as the first recess 71*b*). A screw 54, which is a magnetic member for attracting the first magnet 72*a* is disposed at the bottom (the upper part in FIG. 5A) of the first recess 71*b*.

The first recess 71*a* is formed to have a depth longer than the length of the first magnet 72*a* in the axial direction.

Next, the other magnet 72*b* (hereinafter referred to as the second magnet 72*b*) is accommodated in the second recess 71*b* (hereinafter referred to as the second recess 71*b*) formed on a side surface of the frame body 51, and immobilized in the second recess 71*b* with, for instance, an adhesive. In this example, neodymium magnets causing a strong magnetic fixing force are adopted as the magnets 72*a* and 72*b*.

Thus, the first magnet 72*a* is in an unlocked state in the first recess 71*a*. Accordingly, in a state where the holding frame 5 and the clamp arm 6 do not overlap with each other (i.e., in a state where the clamp arms 6 are opened), the first magnet 72*a* is held in the first recess 71*a* in a state of being attracted by the screw 54 as the magnetic member.

In contrast, in a state where the holding frame 5 and the clamp arm 6 overlap with each other (i.e., a state where the clamp arms 6 are closed), the first magnet 72*a* is strongly attracted by the second magnet 72*b* disposed on the side of the holding frame 5. Accordingly, this magnet is separated from the screw 54 and magnetically attached to the second magnet 72*b* (attached by means of a magnetic force).

At this time, the first magnet 72*a* is slammed off the screw 54, and collides with the second magnet 72*b* accompanied by a collision sound, "click". This allows a user to be notified of the state where the clamp anus 6 are closed with respect to the holding frame 5. Furthermore, the magnets 72*a* and 72*b* are magnetically attached to each other, thereby allowing the clamp arms 6 and 6 to be immobilized.

In this example, the head of the screw 54 is also served as the magnetic member. Instead, a dedicated magnetic member may be provided, and the second magnet 72*b* may be attracted by the dedicated magnetic member in the state where the clamp arms 6 and 6 are opened.

In addition to the first lock means 7 by means of the magnet 72, second lock means 8 for immobilize the clamp arms 6 at the positions where the holding frame 5 and the clamp arms 6 overlap with each other (the positions where the clamp arms 6 are closed) are further provided at the microphone holder 1.

Referring to FIG. 4, the second lock means 8 includes: an engagement rod 81 provided at the frame body 51 of the holing frame 5; and an insertion hole 83 formed in the arm body 61 of the clamp arm 6. The engagement rod 81 is inserted into the insertion hole 83, thereby locking the movement of the clamp anus 6.

In this example, the engagement rod 81 includes a plunger structure where turning of an engagement knob 82 provided at the front end causes the engagement rod 81 to protrude toward the insertion hole 83. However, for instance, a push-push system, a screw system or the like may be adopted as a system for engaging the engagement rod 81. Any system may be adopted in conformity with specifications.

In this example, the second lock means 8 is provided only for one clamp arm 6. However, this means may be provided for each of the arms.

Next, an example of procedures for using the microphone holder 1 will be described. First, the rubber cord 4 is hanged at the hook rods 53 of the microphone holder 1. The rubber cord 4 is further hanged at the hooks 24 of the microphone mounter 2 such that the microphone holder 1 is suspended.

Next, the front end 6*a* of each of the clamp arms 6 and 6 is outwardly opened so as to be resisted to the magnetic fixing force of the magnets 72 and 72. This swings the clamp arm about the swing shaft 52*a*, and the rear end 6*b* of each of the clamp arms 6 and 6 extends to the inside of the holding frame 5.

Pressing of the microphone toward the center of the holding frame 5 from the widened opening between the front ends 6*a* of the clamp arms 6 and 6 causes the microphone M to come into contact with the rear ends 6*b* of the clamp arms 6 and 6. Further pressing closes the front ends 6*a* of the clamp arms 6 and 6.

Subsequently, when the clamp arms 6 and 6 reach respective positions where the magnets 72 and 72 are opposite to each other, the magnetic fixing force of the magnets 72 and 72 fixes the clamp arms 6 and 6. In this example, the clamp arms 6 and 6 are formed into a shape where the length from the swing shaft 62*a* to the front end 6*a* is short and the length from the swing shaft 62*a* to the rear end 6*b* is long. Thus, according to the principle of the lever, even a small force can move the clamp arms 6 and 6 to attach the microphone; in contrast, a strong force is required to detach the microphone. This allows the microphone to be resistant to slipping off by an impact or the like.

In this example, the structure of a type of microphone holder 1 that holds a large-diameter capacitor microphone for studio recording has been exemplified. For instance, a typical dynamic microphone, capacitor microphone or the like may be adopted.

In this example, the microphone holder 1 is suspended by the rubber cord 4 from the microphone mounter 2. However, a mode where the microphone holder 1 is solely attached to the microphone stand may be adopted.

In this example, the case where the microphone holder 1 horizontally holds the microphone M has been exemplified. However, vertical orientation of the microphone holder 1 allows the microphone M to be held in a vertically standing state. The holding orientation by the microphone holder 1 is not particularly limited.

In this example, the microphone grip G is vibration-isolated and prevented from slipping so as not to deviate from the holding position by the vibration isolating rings 55 and 63. In order to improve the close contact force between the microphone holder 1 and the microphone grip G, a non-slip sheet, for instance, a rubber sheet, may intervene therebetween to more securely prevent microphone grip G from positionally deviating.

Furthermore, in this embodiment, the description has been made using the case of application to the microphone holder for holding the microphone grip as a cylindrical body to be held. However, the holding device of a cylindrical body according to the present invention is not limited thereto. More specifically, for instance, a bottle, a can, a PET bottle, a mug, a cup or the like can be held, and the grip of a flashlight, a mop or the like can also be held.

The invention claimed is:

1. A holding device for holding a cylindrical body, comprising:

a holding frame having a C-shaped section for holding an outer circumferential surface of the cylindrical body;

a clamp arm attached swingably at one end portion of the holding frame; and a first lock device for holding the holding frame and the clamp arm at a position where the clamp arm and the holding frame overlap with each other, the first lock device including a first recess formed in one of the holding frame and the clamp arm, a first magnet accommodated in the first recess, a second recess formed in the other of the holding frame and the clamp arm, a second magnet accommodated in the second recess and a magnetic member disposed at a bottom of the first recess to magnetically attract the first magnet, the first and second magnets being magnetically attached to and released from each other in accordance with swing of the clamp arm and being disposed such that the first magnet moves to a side of the second magnet to be magnetically attached to the second magnet at the position where the clamp arm and the holding frame overlap with each other, wherein the first and second magnets respectively have different pole surfaces opposed to each other, and at least the first magnet has an outer diameter smaller than an inner diameter of the first recess, and the holding frame includes a first connecting shaft arranged at the one end portion thereof, and two frame bodies spaced apart from each other; the clamp arm includes two arm bodies spaced apart from each other; and the first connecting shaft connects the frame bodies penetrating through middle portions of the arm bodies such that the arm bodies of the clamp arm are disposed between the frame bodies of the holding frame.

2. The holding device for holding the cylindrical body according to claim 1, wherein the first recess is formed to have a depth longer than a length of the first magnet in an axial direction.

3. The holding device for holding the cylindrical body according to claim 1, further comprising a second lock device for mechanically regulating swing of the clamp arm at the position where the holding frame and the clamp arm overlap with each other.

4. The holding device for holding the cylindrical body according to claim 3, wherein the second lock device includes an insertion hole provided at one of the holding frame and the clamp arm, and an insertion pin provided at the other of the holding frame and the clamp arm, and relative movement between the holding frame and the clamp arm is mechanically locked by inserting the insertion pin into the insertion hole.

5. A microphone holder, comprising the holding device for holding the cylindrical body according to claim 1, wherein the cylindrical body is a microphone grip.

6. The holding device for holding the cylindrical body according to claim 1, wherein the holding frame further includes a second connecting shaft arranged at a center portion thereof to connect the frame bodies, and the clamp arm further includes third connecting shafts arranged at each end portion thereof to connect the arm bodies.

7. The holding device for holding the cylindrical body according to claim 6, wherein the second connecting shaft has first vibration isolating rings arranged at each end portion thereof and facing the frame bodies, respectively, and third connecting shaft has second vibration isolating rings arranged at each end portion thereof and facing the arm bodies, respectively.

8. The holding device for the cylindrical body according to claim 1, wherein the first connecting shaft is arranged at one third of a length of the clamp arm from a front end portion of the clamp arm.

9. A holding device for the cylindrical body, comprising:

a holding frame having a C-shaped section for holding an outer circumferential surface of the cylindrical body;

a clamp arm attached swingably at one end portion of the holding frame; and a first lock device for holding the holding frame and the clamp arm at a position where the clamp arm and the holding frame overlap with each other, the first lock device including a first recess formed in one of the holding frame and the clamp arm, a first magnet accommodated in the first recess, a second recess formed in the other of the holding frame and the clamp arm, a second magnet accommodated in the second recess and a magnetic member disposed at a bottom of the first recess to magnetically attract the first magnet, the first and second magnets being magnetically attached to and released from each other in accordance with swing of the clamp arm and being disposed such that the first magnet moves to a side of the second magnet to be magnetically attached to the second magnet at the position where the clamp arm and the holding frame overlap with each other, wherein the first and second magnets respectively have different pole surfaces opposed to each other, and at least the first magnet has an outer diameter smaller than an inner diameter of the first recess, and the holding frame has another first connecting shaft arranged at another end portion of the C-shaped section, and another clamp arm is pivotally attached to the another end portion of the C-shaped section through the another first connecting shaft penetrating a middle portion of the another clamp arms such that the clamp arms are arranged symmetrical with an axial direction of the holding frame.

10. A holding device for the cylindrical body, comprising:

a holding frame having a C-shaped section for holding an outer circumferential surface of the cylindrical body;

a clamp arm attached swingably at one end portion of the holding frame;

a first lock device for holding the holding frame and the clamp arm at a position where the clamp arm and the holding frame overlap with each other, the first lock device including a first recess formed in one of the holding frame and the clamp arm, a first magnet accommodated in the first recess, a second recess formed in the other of the holding frame and the clamp arm, a second magnet accommodated in the second recess and a magnetic member disposed at a bottom of the first recess to magnetically attract the first magnet, the first and second magnets being magnetically attached to and released from each other in accordance with swing of the clamp arm and being disposed such that the first magnet moves to a side of the second magnet to be magnetically attached to the second magnet at the position where the clamp arm and the holding frame overlap with each other; and a microphone mounter having a hanger arranged along an outer circumference surface of the holding frame and hooks formed on side portions of the hanger, and a rubber cord hooked on the hooks, wherein the first and second magnets respectively have different pole surfaces opposed to each other, and at least the first magnet has an outer diameter smaller than an inner diameter of the first recess, and the holding frame includes hook rods fixed thereon, and the rubber cord is hooked on the hooks and the hook rods such that the holding frame and the clamp are suspended in a space inside the microphone mounter.

* * * * *